US007397329B2

(12) United States Patent
du Toit et al.

(10) Patent No.: US 7,397,329 B2
(45) Date of Patent: Jul. 8, 2008

(54) COMPACT TUNABLE FILTER AND METHOD OF OPERATION AND MANUFACTURE THEREFORE

(76) Inventors: Nicolaas D. du Toit, 10258 Rutland Round Rd., Columbia, MD (US) 21044; Qinghua Kang, 1 Overlook Ct., Newark, DE (US) 19713; Michael Tryson, 2382 Fox Chase Dr., Hanover, PA (US) 17331; James A. Martin, III, 21 Wiley Hill Rd., Londonderry, NH (US) 03053

( * ) Notice: Subject to any disclaimer, the term of this patent is extended or adjusted under 35 U.S.C. 154(b) by 186 days.

(21) Appl. No.: 11/265,459

(22) Filed: Nov. 2, 2005

(65) Prior Publication Data

US 2006/0091980 A1 May 4, 2006

Related U.S. Application Data

(60) Provisional application No. 60/624,339, filed on Nov. 2, 2004.

(51) Int. Cl.
*H01P 1/20* (2006.01)

(52) U.S. Cl. ..... 333/204; 333/202; 333/205

(58) Field of Classification Search ..... 333/202, 333/204, 205

See application file for complete search history.

(56) References Cited

U.S. PATENT DOCUMENTS

| | | | | |
|---|---|---|---|---|
| 4,604,593 | A * | 8/1986 | Yarman | 333/139 |
| 5,312,790 | A | 5/1994 | Sengupta et al. | 501/137 |
| 5,427,988 | A | 6/1995 | Sengupta et al. | 501/137 |
| 5,486,491 | A | 1/1996 | Sengupta et al. | 501/137 |
| 5,593,495 | A | 1/1997 | Masuda et al. | 117/4 |
| 5,635,433 | A | 6/1997 | Sengupta | 501/137 |
| 5,635,434 | A | 6/1997 | Sengupta | 501/138 |
| 5,640,042 | A | 6/1997 | Koscica et al. | 257/595 |
| 5,693,429 | A | 12/1997 | Sengupat et al. | 428/699 |
| 5,694,134 | A | 12/1997 | Barnes | 343/700 |
| 5,766,697 | A | 6/1998 | Sengupta et al. | 427/585 |
| 5,830,591 | A | 11/1998 | Sengupta et al. | 428/701 |
| 5,846,893 | A | 12/1998 | Sengupta et al. | 501/137 |
| 5,886,867 | A | 3/1999 | Chivukula et al. | 361/311 |
| 5,936,492 | A * | 8/1999 | Shingyoji et al. | 333/246 |
| 5,990,766 | A | 11/1999 | Zhang et al. | 333/205 |
| 6,074,971 | A | 6/2000 | Chiu et al. | 501/139 |
| 6,377,142 | B1 | 4/2002 | Chiu et al. | 333/238 |
| 6,377,217 | B1 | 4/2002 | Zhu et al. | 343/700 |
| 6,377,440 | B1 * | 4/2002 | Zhu et al. | 361/311 |
| 6,404,614 | B1 | 6/2002 | Zhu et al. | 361/277 |
| 6,492,883 | B2 | 12/2002 | Liang et al. | 333/132 |

(Continued)

FOREIGN PATENT DOCUMENTS

JP 20040214408 * 7/2004

*Primary Examiner*—Robert J. Pascal
*Assistant Examiner*—Kimberly E Glenn
(74) *Attorney, Agent, or Firm*—James S. Finn

(57) ABSTRACT

An embodiment of the present invention provides an apparatus, comprising a tunable filter with a plurality of bond wires connecting voltage tunable dielectric capacitors to an RF ground and serving as inductors, wherein inductive coupling between the plurality of bond wires serve as coupling between resonators within the tunable filter. The voltage tunable dielectric capacitors may be integrated onto a single MgO chip thereby providing a complete set of tunable capacitors for a filter circuit in a low cost, compact package.

16 Claims, 3 Drawing Sheets

U.S. PATENT DOCUMENTS 6,514,895 B1 2/2003 Chiu et al. ..... 501/137
6,525,630 B1 2/2003 Zhu et al. ..... 333/205
6,531,936 B1 3/2003 Chiu et al. ..... 333/164
6,535,076 B2 3/2003 Partridge et al. ..... 333/17.1
6,538,603 B1 3/2003 Chen et al. ..... 342/372
6,556,102 B1 4/2003 Sengupta et al. ..... 333/161
6,590,468 B2 7/2003 du Toit et al. ..... 333/17.3
6,597,265 B2 7/2003 Liang et al. ..... 333/204
6,806,785 B2 * 10/2004 Traub ..... 331/108 C
6,865,066 B2 * 3/2005 Kurosawa et al. ..... 361/277

* cited by examiner

COMPACT TUNABLE FILTER AND METHOD OF OPERATION AND MANUFACTURE THEREFORE

CROSS REFERENCED TO RELATED APPLICATIONS

This application claims the benefit of priority under 35 U.S.C. Section 119 from U.S. Provisional Application Ser. No. 60/624,339, filed Nov. 2, 2004, entitled, "Miniature Tunable Filter."

BACKGROUND OF THE INVENTION

Varactors are voltage tunable capacitors in which the capacitance is dependent on a voltage applied thereto. Although not limited in this respect, this property has applications in electrically tuning radio frequency (RF) circuits, such as filters, phase shifters, and so on. The most commonly used varactor is a semiconductor diode varactor, which has the advantages of high tunability and low tuning voltage, but suffers low Q, low power handling capability, and limited capacitance range. A new type of varactor is a ferroelectric varactor in which the capacitance is tuned by varying the dielectric constant of a ferroelectric material by changing the bias voltage. Ferroelectric varactors have high Q, high power handling capacity, and high capacitance range.

One ferroelectric varactor is disclosed in U.S. Pat. No. 5,640,042 entitled "Thin Film Ferroelectric Varactor" by Thomas E. Koscica et al. That patent discloses a planar ferroelectric varactor, which includes a carrier substrate layer, a high temperature superconducting metallic layer deposited on the substrate, a lattice matching, a thin film ferroelectric layer deposited on the metallic layer, and a plurality of metallic conductors disposed on the ferroelectric layer and in contact with radio frequency (RF) transmission lines in tuning devices. Another tunable capacitor using a ferroelectric element in combination with a superconducting element is disclosed in U.S. Pat. No. 5,721,194. Tunable varactors that utilize a ferroelectric layer, and various devices that include such varactors are also disclosed in U.S. Pat. No. 6,531,936, entitled "Voltage Tunable Varactors And Tunable Devices Including Such Varactors," filed Oct. 15, 1999, and assigned to the same assignee as the present invention.

Tunable filters are vital to myriad devices. Further, performance improvements are constantly needed and it would advantageous to meet performance requirements such as but not limited to: Less than 3 mm×3 mm×1 mm in size, $0.20 per unit volume production cost, Multi-pole band-pass filter response, Less than 10% 3 dB bandwidth, More than 20% tuning range, Less than 4 dB insertion loss, Higher than 40 dBm Third Order Intercept (IP3).

Previously, attempts to improve tunable filters incorporated fixed capacitors and inductors, bulk acoustic wave resonators, discrete air coils as inductors, distributed transmission line type inductors or resonators and dielectric block resonators. However, these previous attempts at tunable filter performance and size improvements have the following limitations:

a. Fixed capacitors and inductors: No tunability b. Bulk acoustic wave resonators: Very small tuning range c. Discrete air coils as inductors: Large size, low Q-factor, high cost d. Distributed transmission line type inductors or resonators: Large size e. Dielectric block resonators: Very small tuning range Thus, a strong need exists for a compact, improved performance tunable filter and method of operation and manufacture therefore

SUMMARY OF THE INVENTION

An embodiment of the present invention provides an apparatus, comprising a tunable filter with a plurality of bond wires connecting voltage tunable dielectric capacitors to an RF ground and serving as inductors, wherein inductive coupling between the plurality of bond wires serve as coupling between resonators within the tunable filter. The voltage tunable dielectric capacitors may be integrated onto a single MgO chip thereby providing a complete set of tunable capacitors for a filter circuit in a low cost, compact package.

The voltage tunable dielectric capacitors may be of the vertical type for high tuning range and low voltage control and the voltage tunable dielectric capacitors may be dimensioned for sufficient capacitance values to achieve a predetermined intermodulation performance. The voltage tunable dielectric capacitors may be arranged in series-connected pairs with bias voltage applied at a center tap and the other terminals held at DC ground potential with each pair acting as a single capacitor with enhanced IP3 performance and improved noise rejection, and further the center tap of at least one voltage tunable dielectric capacitor pair may be connected to platinum electrodes of two vertical voltage tunable dielectric capacitors and the layout of active areas and platinum electrodes may be such that an RF path length within platinum may be very short, thereby reducing losses due to the low conductivity of the platinum. The plurality of bond wires may be used for low losses and a high Q-factor and may be ribbon bond wires and may be used for low losses and a high Q-factor. Further, the tunable filter may have a balanced structure for improved noise rejection and enhanced IP3 performance and the plurality of bond wires may be replaced with microstrip traces, wherein the traces may act as coupled inductors for the filter.

Another embodiment of the present invention provides a method, comprising connecting voltage tunable dielectric capacitors in a tunable filter with a plurality of bond wires to an RF ground, the plurality of bond wires serving as inductors and wherein inductive coupling between the plurality of bond wires serve as coupling between resonators within the tunable filter.

Yet another embodiment of the present invention provides a method of manufacturing a tunable filter, comprising connecting voltage tunable dielectric capacitors to an RF ground with a plurality of bond wires and serving as inductors in the tunable filter, wherein inductive coupling between the plurality of bond wires may serve as coupling between resonators within the tunable filter. This method of manufacturing may provide that the voltage tunable dielectric capacitors are integrated onto a single MgO chip, providing a complete set of tunable capacitors for a filter circuit in a low cost, compact package, although the present invention is not limited in this respect.

BRIEF DESCRIPTION OF THE DRAWINGS

The present invention is described with reference to the accompanying drawings. In the drawings, like reference numbers indicate identical or functionally similar elements. Additionally, the left-most digit(s) of a reference number identifies the drawing in which the reference number first appears.

DETAILED DESCRIPTION

In the following detailed description, numerous specific details are set forth in order to provide a thorough understanding of the invention. However, it will be understood by those skilled in the art that the present invention may be practiced without these specific details. In other instances, well-known methods, procedures, components and circuits have not been described in detail so as not to obscure the present invention.

An embodiment of the present invention provides that a plurality of voltage tunable dielectric capacitors (also referred to herein as Parascan® Tunable Capacitors PTCs or vertical Parascan® Tunable Capacitors PTCs) may be integrated onto a single MgO chip, providing a complete set of tunable capacitors for the filter circuit in a low cost, compact package. It is understood that the present invention is not limited to MgO chips and are used herein as example of one type of chip that may be used. In an embodiment of the present invention, the PTC's may be of the vertical type for high tuning range and low voltage control.

Further, the PTC's may be dimensioned for sufficient capacitance values to achieve a desired intermodulation performance. In an embodiment of the present invention and not limited in this respect, the PTC's may be arranged in series-connected pairs with the bias voltage applied at a center tap and the other terminals held at DC ground potential, each pair acting as a single capacitor with enhanced IP3 performance and improved noise rejection.

The center tap of a the PTC pair may be connected to the platinum electrodes of the two vertical mode PTC's and the layout of the active areas and platinum electrodes may be such that the RF path length within platinum is very short, thereby reducing losses (increasing Q-factor) due to the low conductivity of the platinum. Bond wires connecting the PTC's to RF ground may serve as inductors of very compact size and low cost. Further, inductive coupling between bond wires may serve as coupling between resonators to achieve a very compact size and low component count (low cost).

In an embodiment of the present invention, multiple bond wires may be used for low losses (high Q-factor). Further, ribbon bond wires may be used for low losses (high Q-factor). The filter may have a balanced structure for improved noise rejection and enhanced IP3 performance. In an alternative embodiment present invention, the bond wires may be replaced with microstrip traces. As such the microstrip traces may act as coupled inductors for the filter.

Figure 1:
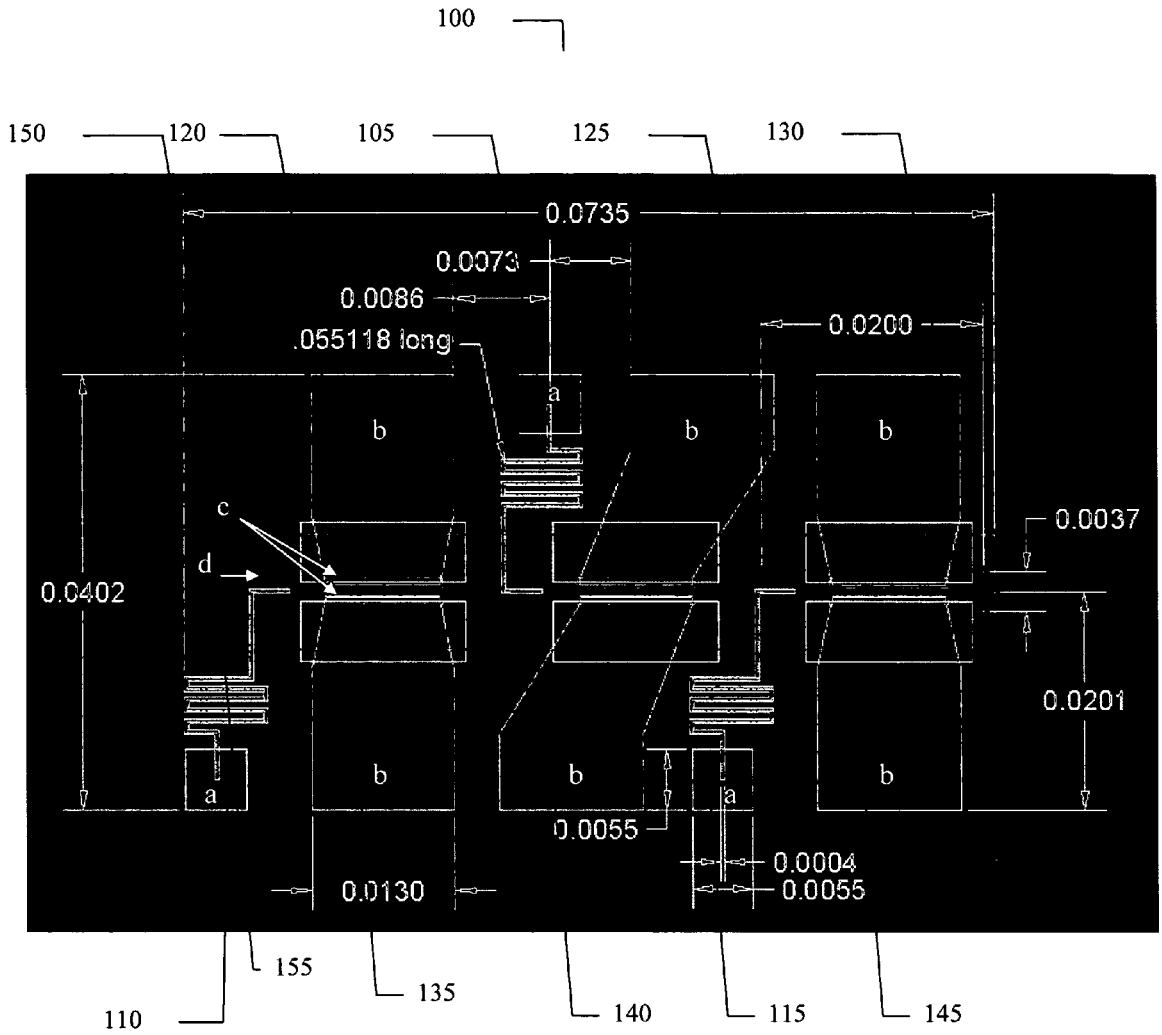
FIG. 1 illustrates the layout of an MgO chip showing integrated voltage tunable dielectric capacitors of one embodiment of the present invention.

Turning now to FIG. 1 at 100 is a layout of an MgO chip showing integrated PTC's. It is noted that the dimensions shown in FIG. 1 (in inches) are for one embodiment and various dimensions are intended to be within the scope of the present invention. The MgO chip 100 of one embodiment of the present invention provides bias connections 105, 110 and 115; RF connections (Gold in one embodiment), 120, 125, 130, 135, 140, and 145; active areas 150; and platinum electrodes 155.

Figure 2:
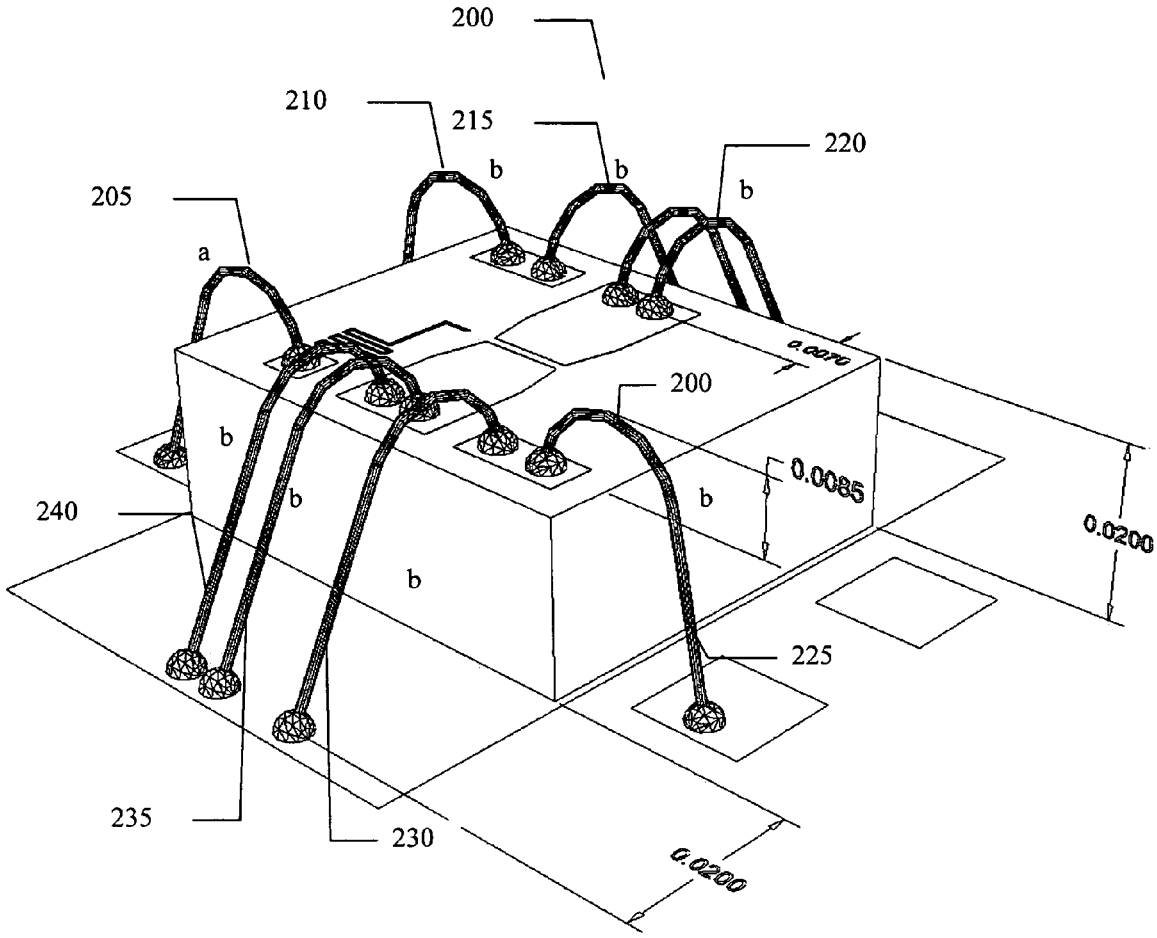
FIG. 2 illustrates bond wires as inductors of one embodiment of the present invention.

FIG. 2 at 200 illustrates bond wires as inductors of one embodiment of the present invention—again it is noted that the dimensions shown in FIG. 2 (in inches) are for one embodiment and various dimensions are intended to be within the scope of the present invention. The compact, high performance tunable filter of FIG. 2 includes bias connection 205 and RF connections 210, 215, 220, 225, 230, 235 and 240.

Figure 3:
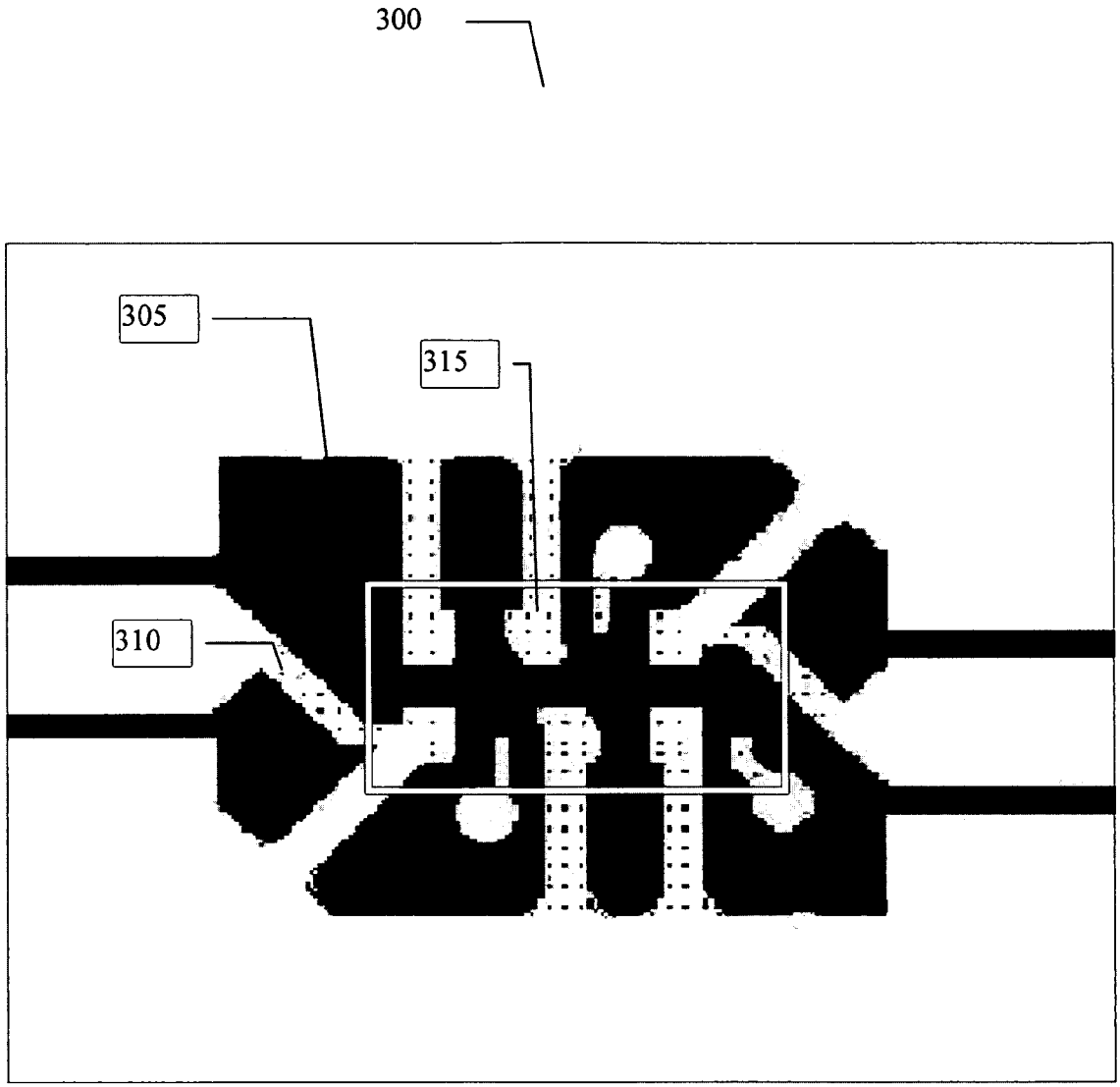
FIG. 3 shows microstrip traces implemented as coupled inductors in an embodiment of the present invention.

FIG. 3 at 300 shows microstrip traces 310 implemented as coupled inductors in an embodiment of the present invention. Microstrip traces 310 comprising conductive (metal, for example, but not limited to copper) areas on a printed circuit board (PCB) 305 acting as dielectric with conductive ground layer (metal, for example, but not limited to. copper) on the opposite surface (not shown) of the PCB. General area 315 may be occupied by the MgO chip with integrated PTC's and soldered to the microstrip traces, face-down (flip-chipped).

Throughout the aforementioned description, BST has been used as a tunable dielectric material that may be used in a tunable dielectric capacitor of the present invention. However, the assignee of the present invention, Paratek Microwave, Inc. has developed and continues to develop tunable dielectric materials that may be utilized in embodiments of the present invention and thus the present invention is not limited to using BST material. This family of tunable dielectric materials may be referred to as Parascan®.

The term Parascan® as used herein is a trademarked term indicating a tunable dielectric material developed by the assignee of the present invention. Parascan® tunable dielectric materials have been described in several patents. Barium strontium titanate (BaTiO3-SrTiO3), also referred to as BSTO, is used for its high dielectric constant (200-6,000) and large change in dielectric constant with applied voltage (25-75 percent with a field of 2 Volts/micron). Tunable dielectric materials including barium strontium titanate are disclosed in U.S. Pat. No. 5,312,790 to Sengupta, et al. entitled "Ceramic Ferroelectric Material"; U.S. Pat. No. 5,427,988 by Sengupta, et al. entitled "Ceramic Ferroelectric Composite Material-BSTO-MgO"; U.S. Pat. No. 5,486,491 to Sengupta, et al. entitled "Ceramic Ferroelectric Composite Material-BSTO-ZrO2"; U.S. Pat. No. 5,635,434 by Sengupta, et al. entitled "Ceramic Ferroelectric Composite Material-BSTO-Magnesium Based Compound"; U.S. Pat. No. 5,830,591 by Sengupta, et al. entitled "Multilayered Ferroelectric Composite Waveguides"; U.S. Pat. No. 5,846,893 by Sengupta, et al. entitled "Thin Film Ferroelectric Composites and Method of Making"; U.S. Pat. No. 5,766,697 by Sengupta, et al. entitled "Method of Making Thin Film Composites"; U.S. Pat. No. 5,693,429 by Sengupta, et al. entitled "Electronically Graded Multilayer Ferroelectric Composites"; U.S. Pat. No. 5,635,433 by Sengupta entitled "Ceramic Ferroelectric Composite Material BSTO-ZnO"; U.S. Pat. No. 6,074,971 by Chiu et al. entitled "Ceramic Ferroelectric Composite Materials with Enhanced Electronic Properties BSTO Mg Based Compound-Rare Earth Oxide". These patents are incorporated herein by reference. The materials shown in these patents, especially BSTO-MgO composites, show low dielectric loss and high tunability. Tunability is defined as the fractional change in the dielectric constant with applied voltage.

Barium strontium titanate of the formula BaxSr1-xTiO3 is a preferred electronically tunable dielectric material due to its favorable tuning characteristics, low Curie temperatures and low microwave loss properties. In the formula BaxSr1-xTiO3, x can be any value from 0 to 1, preferably from about 0.15 to about 0.6. More preferably, x is from 0.3 to 0.6.

Other electronically tunable dielectric materials may be used partially or entirely in place of barium strontium titanate. An example is BaxCa1-xTiO3, where x is in a range from about 0.2 to about 0.8, preferably from about 0.4 to about 0.6. Additional electronically tunable ferroelectrics include PbxZr1-xTiO3 (PZT) where x ranges from about 0.0 to about 1.0, PbxZr1-xSrTiO3 where x ranges from about 0.05 to about 0.4, KTaxNb1-xO3 where x ranges from about 0.0 to about 1.0, lead lanthanum zirconium titanate (PLZT), PbTiO3, BaCaZrTiO3, NaNO3, KNbO3, LiNbO3, LiTaO3, PbNb2O6, PbTa2O6, KSr(NbO3) and NaBa2(NbO3) 5KH2PO4, and mixtures and compositions thereof. Also, these materials can be combined with low loss dielectric materials, such as magnesium oxide (MgO), aluminum oxide (Al2O3), and zirconium oxide (ZrO2), and/or with additional doping elements, such as manganese (MN), iron (Fe), and tungsten (W), or with other alkali earth metal oxides (i.e. calcium oxide, etc.), transition metal oxides, silicates, niobates, tantalates, aluminates, zirconnates, and titanates to further reduce the dielectric loss.

In addition, the following U.S. patents and patent Applications, assigned to the assignee of this application, disclose additional examples of tunable dielectric materials: U.S. Pat. No. 6,514,895, entitled "Electronically Tunable Ceramic Materials Including Tunable Dielectric and Metal Silicate Phases"; U.S. Pat. No. 6,774,077, entitled "Electronically Tunable, Low-Loss Ceramic Materials Including a Tunable Dielectric Phase and Multiple Metal Oxide Phases"; U.S. Pat. No. 6,737,179 filed Jun. 15, 2001, entitled "Electronically Tunable Dielectric Composite Thick Films And Methods Of Making Same; U.S. Pat. No. 6,617,062 entitled "Strain-Relieved Tunable Dielectric Thin Films"; U.S. Pat. No. 6,905,989, filed May 31, 2002, entitled "Tunable Dielectric Compositions Including Low Loss Glass"; U.S. patent application Ser. No. 10/991,924, filed Nov. 18, 2004, entitled "Tunable Low Loss Material Compositions and Methods of Manufacture and Use Therefore" These patents and patent applications are incorporated herein by reference.

The tunable dielectric materials can also be combined with one or more non-tunable dielectric materials. The non-tunable phase(s) may include MgO, MgAl2O4, MgTiO3, Mg2SiO4, CaSiO3, MgSrZrTiO6, CaTiO3, Al2O3, SiO2 and/or other metal silicates such as BaSiO3 and SrSiO3. The non-tunable dielectric phases may be any combination of the above, e.g., MgO combined with MgTiO3, MgO combined with MgSrZrTiO6, MgO combined with Mg2SiO4, MgO combined with Mg2SiO4, Mg2SiO4 combined with CaTiO3 and the like.

Additional minor additives in amounts of from about 0.1 to about 5 weight percent can be added to the composites to additionally improve the electronic properties of the films. These minor additives include oxides such as zirconnates, tannates, rare earths, niobates and tantalates. For example, the minor additives may include CaZrO3, BaZrO3, SrZrO3, BaSnO3, CaSnO3, MgSnO3, Bi2O3/2SnO2, Nd2O3, Pr7O11, Yb2O3, Ho2O3, La2O3, MgNb2O6, SrNb2O6, BaNb2O6, MgTa2O6, BaTa2O6 and Ta2O3.

Films of tunable dielectric composites may comprise Ba1-xSrxTiO3, where x is from 0.3 to 0.7 in combination with at least one non-tunable dielectric phase selected from MgO, MgTiO3, MgZrO3, MgSrZrTiO6, Mg2SiO4, CaSiO3, MgAl2O4, CaTiO3, Al2O3, SiO2, BaSiO3 and SrSiO3. These compositions can be BSTO and one of these components, or two or more of these components in quantities from 0.25 weight percent to 80 weight percent with BSTO weight ratios of 99.75 weight percent to 20 weight percent.

The electronically tunable materials may also include at least one metal silicate phase. The metal silicates may include metals from Group 2A of the Periodic Table, i.e., Be, Mg, Ca, Sr, Ba and Ra, preferably Mg, Ca, Sr and Ba. Preferred metal silicates include Mg2SiO4, CaSiO3, BaSiO3 and SrSiO3. In addition to Group 2A metals, the present metal silicates may include metals from Group 1A, i.e., Li, Na, K, Rb, Cs and Fr, preferably Li, Na and K. For example, such metal silicates may include sodium silicates such as Na2SiO3 and NaSiO3-5H2O, and lithium-containing silicates such as LiAlSiO4, Li2SiO3 and Li4SiO4. Metals from Groups 3A, 4A and some transition metals of the Periodic Table may also be suitable constituents of the metal silicate phase. Additional metal silicates may include Al2Si2O7, ZrSiO4, KalSi3O8, NaAlSi3O8, CaAl2Si2O8, CaMgSi2O6, BaTiSi3O9 and Zn2SiO4. The above tunable materials can be tuned at room temperature by controlling an electric field that is applied across the materials.

In addition to the electronically tunable dielectric phase, the electronically tunable materials can include at least two additional metal oxide phases. The additional metal oxides may include metals from Group 2A of the Periodic Table, i.e., Mg, Ca, Sr, Ba, Be and Ra, preferably Mg, Ca, Sr and Ba. The additional metal oxides may also include metals from Group 1A, i.e., Li, Na, K, Rb, Cs and Fr, preferably Li, Na and K. Metals from other Groups of the Periodic Table may also be suitable constituents of the metal oxide phases. For example, refractory metals such as Ti, V, Cr, Mn, Zr, Nb, Mo, Hf, Ta and W may be used. Furthermore, metals such as Al, Si, Sn, Pb and Bi may be used. In addition, the metal oxide phases may comprise rare earth metals such as Sc, Y, La, Ce, Pr, Nd and the like.

The additional metal oxides may include, for example, zirconnates, silicates, titanates, aluminates, stannates, niobates, tantalates and rare earth oxides. Preferred additional metal oxides include Mg2SiO4, MgO, CaTiO3, MgZrSrTiO6, MgTiO3, MgAl2O4, WO3, SnTiO4, ZrTiO4, CaSiO3, CaSnO3, CaWO4, CaZrO3, MgTa2O6, MgZrO3, MnO2, PbO, Bi2O3 and La2O3. Particularly preferred additional metal oxides include Mg2SiO4, MgO, CaTiO3, MgZrSrTiO6, MgTiO3, MgAl2O4, MgTa2O6 and MgZrO3.

The additional metal oxide phases are typically present in total amounts of from about 1 to about 80 weight percent of the material, preferably from about 3 to about 65 weight percent, and more preferably from about 5 to about 60 weight percent. In one preferred embodiment, the additional metal oxides comprise from about 10 to about 50 total weight percent of the material. The individual amount of each additional metal oxide may be adjusted to provide the desired properties. Where two additional metal oxides are used, their weight ratios may vary, for example, from about 1:100 to about 100:1, typically from about 1:10 to about 10:1 or from about 1:5 to about 5:1. Although metal oxides in total amounts of from 1 to 80 weight percent are typically used, smaller additive amounts of from 0.01 to 1 weight percent may be used for some applications.

The additional metal oxide phases can include at least two Mg-containing compounds. In addition to the multiple Mg-containing compounds, the material may optionally include Mg-free compounds, for example, oxides of metals selected from Si, Ca, Zr, Ti, Al and/or rare earths.

While the present invention has been described in terms of what are at present believed to be its preferred embodiments, those skilled in the art will recognize that various modifications to the disclose embodiments can be made without departing from the scope of the invention as defined by the following claims.

What is claimed is:

1. An apparatus, comprising:

a tunable filter with a plurality of bond wires connecting voltage tunable dielectric capacitors to an RF ground and serving as inductors, wherein inductive coupling between said plurality of bond wires serve as coupling between resonators within said tunable filter wherein said tunable filter has a balanced structure for improved noise rejection and enhanced IP3 performance.

2. The apparatus of claim 1, wherein said voltage tunable dielectric capacitors are integrated onto a single MgO chip, providing a complete set of tunable capacitors for a filter circuit in a low cost, compact package.

3. The apparatus of claim 1, wherein said voltage tunable dielectric capacitors are vertical for high tuning range and low voltage control.

4. The apparatus of claim 1, wherein said voltage tunable dielectric capacitors are dimensioned for sufficient capacitance values to achieve a predetermined intermodulation performance.

5. The apparatus of claim 1, wherein said voltage tunable dielectric capacitors are arranged in series-connected pairs with bias voltage applied at a center tap and other terminals held at DC ground potential with each pair acting as a single capacitor with enhanced IP3 performance and improved noise rejection.

6. The apparatus of claim 1, wherein said plurality of bond wires are used for low losses and a high Q-factor.

7. The apparatus of claim 6, wherein said plurality of bond wires are ribbon bond wires and are used for low losses and a high Q-factor.

8. The apparatus of claim 1, wherein said plurality of bond wires are replaced with microstrip traces and wherein said traces act as coupled inductors for the filter.

9. A method, comprising:

connecting voltage tunable dielectric capacitors in a tunable filter with a plurality of bond wires to an RF ground, said plurality of bond wires serving as inductors and wherein inductive coupling between said plurality of bond wires serve as coupling between resonators within said tunable filter, wherein said tunable filter has a balanced structure for improved noise rejection and enhanced IP3 performance.

10. The method of claim 9, further comprising integrating said voltage tunable dielectric capacitors onto a single MgO chip thereby providing a complete set of tunable capacitors for a filter circuit in a low cost, compact package.

11. The method of claim 9, wherein said voltage tunable dielectric capacitors are vertical for high tuning range and low voltage control.

12. The method of claim 9, further comprising dimensioning said voltage tunable dielectric capacitors for sufficient capacitance values to achieve a predetermined intermodulation performance.

13. The method of claim 9, further comprising arranging said voltage tunable dielectric capacitors in series-connected pairs with bias voltage applied at a center tap and other terminals held at DC ground potential with each pair acting as a single capacitor with enhanced IP3 performance and improved noise rejection.

14. The method of claim 9, further comprising using said plurality of bond wires for low losses and a high Q-factor.

15. The method of claim 14, wherein said plurality of bond wires are ribbon bond wires and are used for low losses and a high Q-factor.

16. The method of claim 9, further comprising replacing said plurality of bond wires with microstrip traces, wherein said traces act as coupled inductors for the filter.

* * * * *